US007163281B2

(12) United States Patent
Simon et al.

(10) Patent No.: US 7,163,281 B2
(45) Date of Patent: Jan. 16, 2007

(54) METHOD FOR IMPROVING DROP CHARGING ASSEMBLY FLATNESS TO IMPROVED DROP CHARGE UNIFORMITY IN PLANAR ELECTRODE STRUCTURES

(75) Inventors: Robert J. Simon, Bellbrook, OH (US); Kenneth C. Harrington, Beavercreek, OH (US)

(73) Assignee: Eastman Kodak Company, Rochester, NY (US)

( * ) Notice: Subject to any disclaimer, the term of this patent is extended or adjusted under 35 U.S.C. 154(b) by 304 days.

(21) Appl. No.: 10/839,359

(22) Filed: May 5, 2004

(65) Prior Publication Data

US 2005/0248632 A1 Nov. 10, 2005

(51) Int. Cl.
*B41J 2/085* (2006.01)

(52) U.S. Cl. ..... 347/76

(58) Field of Classification Search ..... 347/73–74, 347/76–78, 90

See application file for complete search history.

(56) References Cited

U.S. PATENT DOCUMENTS 4,364,057 A * 12/1982 Ebi et al. ..... 347/81
4,622,562 A 11/1986 Pipkorn et al.
4,928,116 A * 5/1990 Wood ..... 347/76
4,937,589 A * 6/1990 Fagerquist et al. ..... 347/75
5,475,411 A * 12/1995 Strain et al. ..... 347/90
6,247,800 B1 * 6/2001 Mutoh ..... 347/74
6,511,164 B1 1/2003 Bajeux

FOREIGN PATENT DOCUMENTS

EP 0 744 290 11/1996

* cited by examiner

*Primary Examiner*—K. Feggins
(74) *Attorney, Agent, or Firm*—The Buskop Law Group, PC

(57) ABSTRACT

An improved continuous ink jet print station includes a drop generator with a jet array and a drop charging assembly. The drop charging assembly includes a substrate with a first side facing the jet array, and one or more resistive heater elements placed on the substrate aligned with the jet array. The resistive heater elements are discontinuously disposed on portions of the substrate. One or more one charging electrodes are disposed on the first side. The continuous ink jet print station includes a power source for powering the resistive heater elements to heat the substrate to a temperature sufficient to prevent condensation of fluid on the first side.

17 Claims, 4 Drawing Sheets

METHOD FOR IMPROVING DROP CHARGING ASSEMBLY FLATNESS TO IMPROVED DROP CHARGE UNIFORMITY IN PLANAR ELECTRODE STRUCTURES

FIELD OF THE INVENTION

The present embodiments relate to methods for providing an improved drop charging assembly for a print station. Better drop control is realized by increasing the uniformity of the charge on catch drops and reducing the variation of the charge on print drops that typically cause poor print quality

BACKGROUND OF THE INVENTION

In continuous ink jet printing, electrically conductive ink is supplied under pressure to a region that distributes the ink via a plurality of orifices, typically arranged in a linear array. The ink discharges from the orifices, forming a jet array, which breaks into droplet streams. Individual ink droplets in the droplet streams are selectively charged by a drop charging assembly, which deflects the drops from their normal trajectories. The deflected drops may be caught and recirculated. The undeflected drops are allowed to proceed to a print medium forming an image.

Drops are typically charged by a drop charging assembly having a plurality of charging electrodes along one edge, and a corresponding plurality of connecting leads along one of the faces. The edge of the drop charging assembly, having charging electrodes, is placed in close proximity to the ink droplet stream. Charges are applied to the leads to induce charges in the drops as they break off from the jet array.

Uniformity of drop charge is essential in continuous ink jet printheads utilizing planar electrode structures. These printheads require a substantial difference in charge for the "catch drops" compared to the "print drops". Drops with a high charge are attracted towards a catcher and recycled. Drops with a low charge are printed on print media. Print quality defects are introduced if the charge on the print drops is excessive or uncontrolled. Nominal charge level on the print drops varies in each printhead design.

Pipkorn U.S. Pat. No. 4,622,562 teaches that a charge plate for a printhead must be heated to prevent the formation of condensate, see also, Wood U.S. Pat. No. 4,928,116. The prior art described herein are incorporated by reference.

A need exists to improve print quality with a better drop charging assembly, in particular, for print stations with arrays longer than 4 inches.

The present embodiments described herein were designed to meet these needs.

SUMMARY OF THE INVENTION

The continuous ink jet print station includes a fluid system that provides fluid to a drop generator. The drop generator has a jet array, a midpoint, and a catcher assembly opposite the jet array to return fluid to the fluid system. The print station includes a drop charging assembly disposed opposite the jet array for charging drops from fluid projected from the jet array.

The drop charging assembly has a substrate with a first side facing the jet array with a first side surface area. The assembly has multiple resistive heater elements placed on the substrate aligned with the jet array. The multiple resistive heater elements are discontinuously disposed on portions of the substrate. The assembly has one or more charging electrodes disposed on the first side in communication with drop charging electronics and a power source to provide voltage to the resistive heater elements to heat the substrate to a temperature sufficient to prevent condensation of fluid on the first side while minimizing distortion of the first side.

BRIEF DESCRIPTION OF THE DRAWINGS

In the detailed description of the preferred embodiments presented below, reference is made to the accompanying drawings, in which.

The present embodiments are detailed below with reference to the listed Figures.

DETAILED DESCRIPTION OF THE INVENTION

Before explaining the present embodiments in detail, it is to be understood that the embodiments are not limited to the particular descriptions and that it can be practiced or carried out in various ways.

The improved drop charging assembly for an ink jet print station has discontinuous, resistive heater elements that minimize condensation on the drop charging assembly while creating a uniform charge on the "catch drops" and "print drops" of the print station.

The improved drop charging assembly provides better manufacturing yields, better printhead reliability, and better print quality, particularly for drop generators with orifice plates with small orifices.

The improved drop charging assembly is particularly valuable with long arrays of jets in printheads, which have a tendency to otherwise deform while heating with other types of heating elements. The improved drop charging assembly results in lower energy needed to remove condensate formed on the drop charging assembly.

This improved drop charging assembly enables the printhead to be maintained more easily than other printheads. One embodiment describes a design that includes making a multilayer resistive heater element directly on the substrate of the drop charging assembly, thereby lowering manufacturing costs when compared to other processes that require separate heater elements to be manufactured and assembled on the drop charging assembly.

Figure 1:
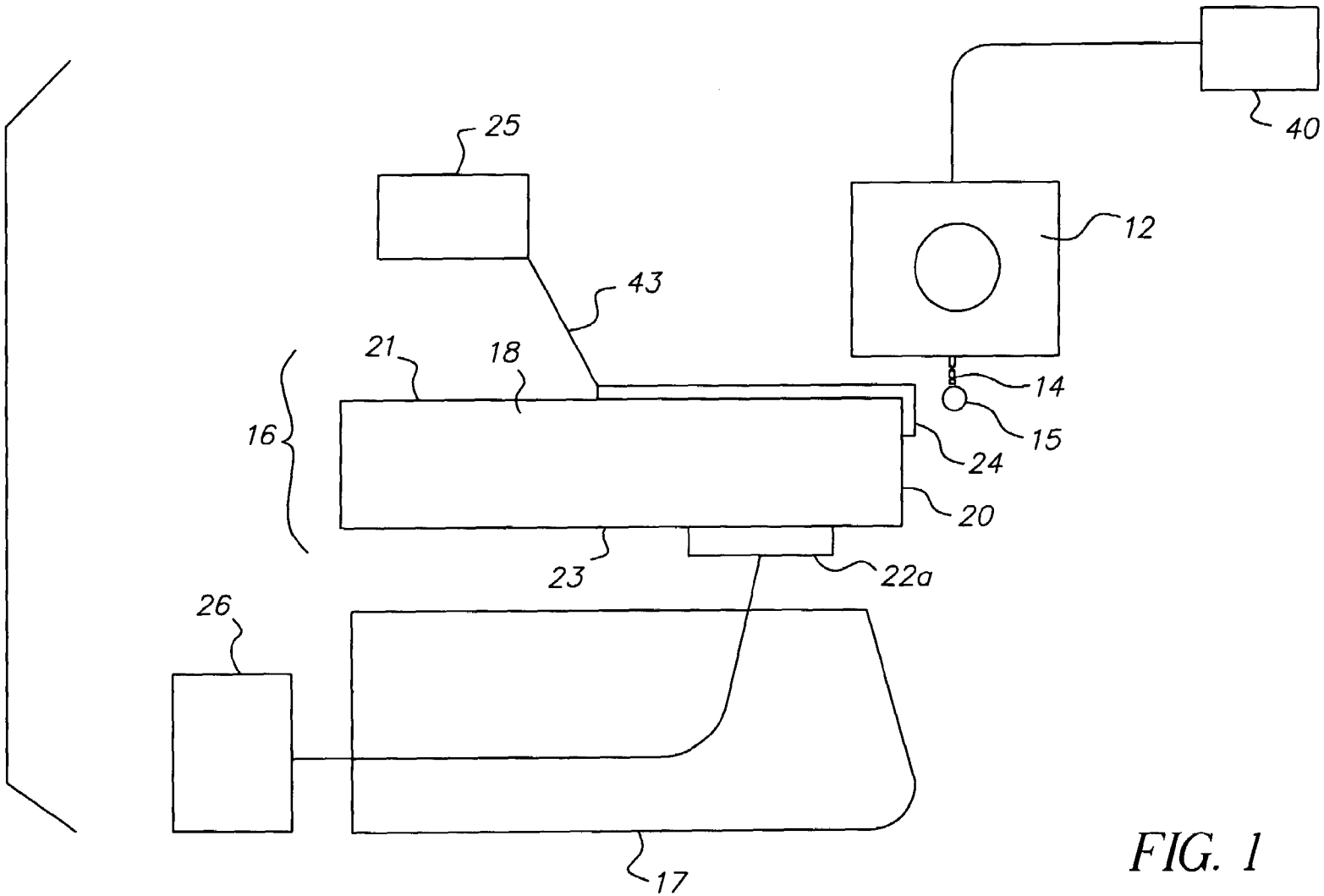
FIG. 1 depicts a side view of a print station with the improved drop charging assembly.

With reference to the figures, FIG. 1 depicts an overall design of a continuous ink jet print station with the improved drop charging assembly. The continuous ink jet print station includes a drop generator 12 with a jet array 14 for projecting ink droplets 15, and a drop charging assembly 16. A catcher assembly 17 is disposed opposite the jet array 14. The drop charging assembly 16 includes a substrate 18 having a first side 20 facing the jet array 14. A fluid system 40 supplies ink or other fluids to the drop generator 12. An example of an ink jet print station is a Kodak Versamark DT92 print station available from Kodak Versamark of Dayton, Ohio.

The substrate 18 has a second side 21 that has a common edge with the first side 20. The second side 21 has a surface area greater than the first side 20 surface area. The substrate 18 has a third side 23 having a common edge with the first side 20 opposite the common edge of the second side 21. The third side 23 surface area is greater than the first side 20 surface area.

At least one charging electrode 24 is disposed on the first side 20 and at least one resistive heater element 22*a* is disposed on the third side 23.

Drop charging electronics 25 connect to the charging electrode 24. A power source 26 connects to the resistive heater element 22*a*. One power source 26 can power each resistive heater element, but it is possible to have one power source 26 that supplies voltages to all the resistive heater elements disposed on the substrate 18.

The substrate 18 can be ceramic, glass, metal, polymer, composites thereof, laminates thereof, and combinations thereof. Another preferred substrate material is alumina.

Figure 2:
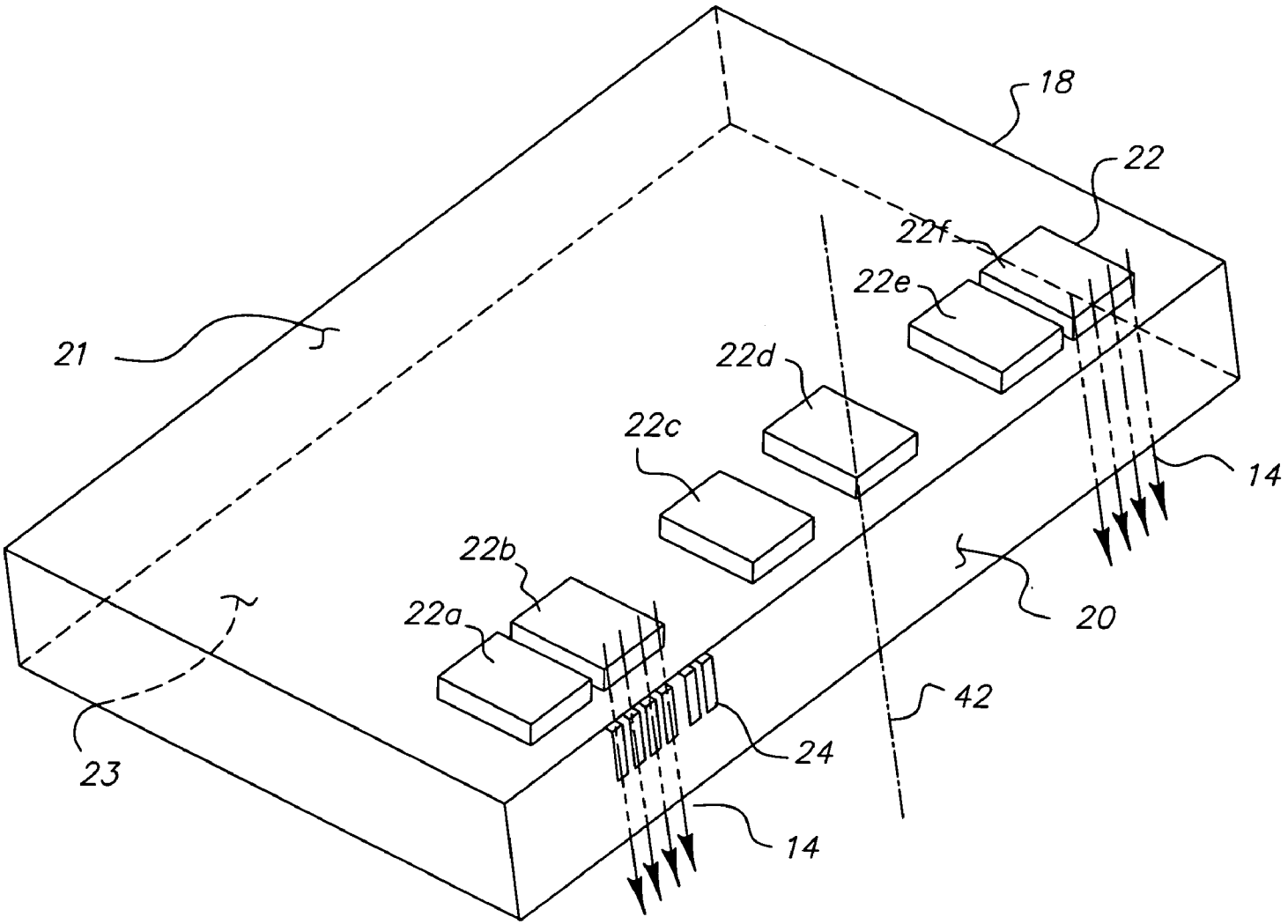
FIG. 2 depicts a perspective view of a second embodiment of the drop charging assembly wherein multiple resistive heater elements are discontinuously disposed on a second side of a substrate.

In a preferred embodiment, the drop charging assembly 16 includes at least one resistive heater element 22*a* on the substrate 18 extending parallel to the jet array 14, but discontinuously disposed on selected portions of the substrate 18. The resistive heater element 22 is shown in segments in FIG. 2. At least six resistive heater elements 22*a*, 22*b*, 22*c*, 22*d*, 22*e*, and 22*f* are preferably disposed on the substrate 18 for an exemplary printhead using 300 orifices per inch. The three important sides of the substrate, 20, 21 and 23, are shown in FIG. 2. The resistive heater elements are shown on second side of the substrate 21.

In this embodiment, the six resistive heater elements are shown in a preferred embodiment paired together, and disposed symmetrically around the midpoint 42 of the jet array.

Figure 3:
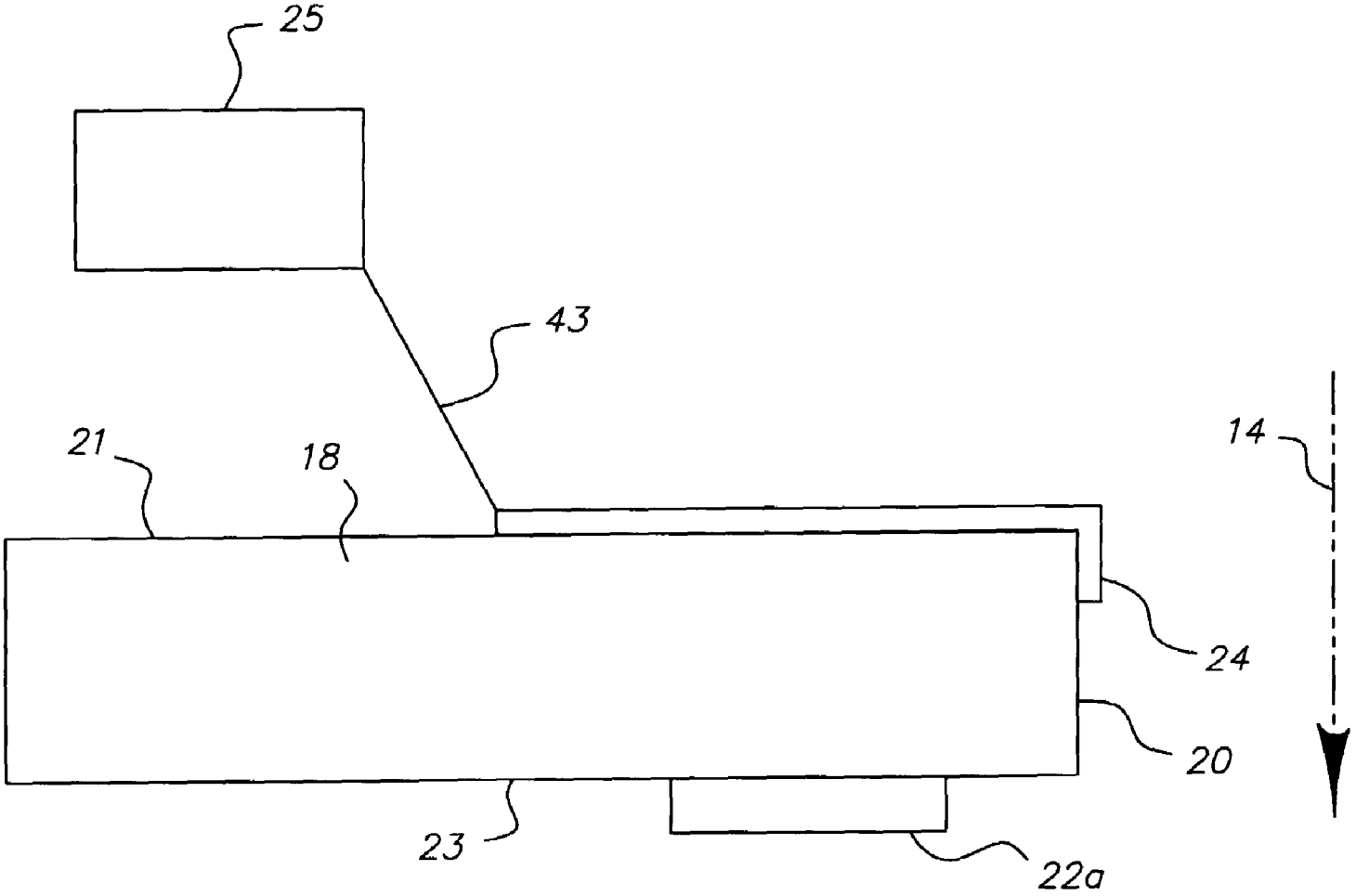
FIG. 3 depicts a side view of an embodiment of FIG. 1 wherein each resistive heater element is on a third side of the substrate.
Figure 4:
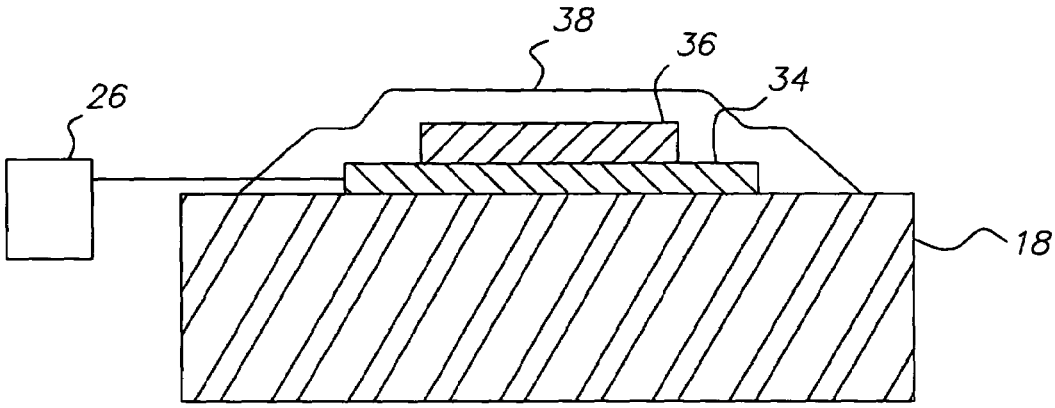
FIG. 4 depicts a detailed section view of a resistive heater element built on a substrate for use in the improved drop charging assembly.

FIG. 3 shows another embodiment of the resistive heater element on the third side 23 of the substrate, which is the side opposite 21 of the substrate 18. The jet is shown in this embodiment. The charging electrode 24 is disposed on the first side of the substrate 20 that connects to drop charging electronics 25 by way of conductors 43 disposed on the second side 21.

The charging electrode is typically disposed on the first side in the most preferred embodiment. Any method for forming electrodes or circuit traces on a substrate can be used to form the charging electrodes. Particular processes described by Morris in U.S. Pat. No. 5,512,117, are preferred methods and incorporated herein.

The resistive heater element can be formed by using sequential thick film deposition processes, such as screen printing and firing between layers, directly on the substrate.

The resistive heater elements can be printed or created as a group, saving time over labor intensive resistor build, and adheres to techniques that have existed.

The resistive heater elements can be used as a circuit layer 34 to form the leads to the resistive elements, for instance, a DuPont 6160 from E.I. DuPont of Wilmington, Del. An example of a resistive layer 36 used to form the heaters is a DuPont Q587 resistor. As for the dielectric coating layer 38 to protect both the circuit layer and the resistive layer, a DuPont 9615 dielectric material can be used.

In the most preferred embodiment, multiple resistive heater elements are placed on the substrate on a side different from the first side but aligned with the jet array and in proximate relation to the first side.

In another embodiment, the resistive heater element can be formed on a non-conductive polymer sheet, such as a polyimide, that is laminated to the substrate. In another embodiment, the resistive heater element can be formed using vacuum depositing, sputtering, evaporation, and vapor deposition of the layers onto the substrate. If sputtering is performed, the substrate is placed in a vacuum chamber, plasma is generated in a passive source gas in the chamber, and ion bombardment is directed toward the substrate, causing material to be sputtered off the target and condensed on the substrate. For evaporation, the substrate is placed in a high vacuum chamber at room temperature with a crucible containing the material to be deposited. A heating source is used to heat the crucible, causing the material to evaporate and condense on the substrate. Finally, low pressure chemical vapor deposition is performed in a reactor at temperatures up to 900° C. The deposited film is a product of a chemical reaction between the source gases supplied to the reactor.

Each resistive heater element has a separate power source 26. For example, a PS1-01-687, a 24 volt DC power supply can be used, which is available from VICOR of Sunnyvale, Calif.

Figure 5:
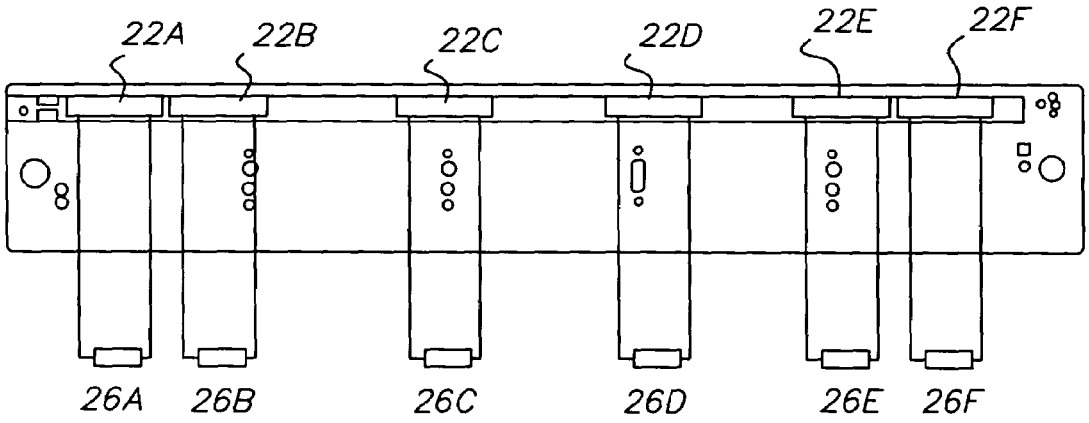
FIG. 5 depicts an embodiment of FIG. 1 wherein each resistive heater element has its own power source.

FIG. 5 shows six resistive heater elements 22*a*, 22*b*, 22*c*, 22*d*, 22*e* and 22*f*, each with a power source 26*a*, 26*b*, 26*c*, 26*d*, 26*e*, and 26*f* respectively. The power sources could be the VICOR part described above.

The drop charging assembly can further include at least one charging electrode 24 disposed on the first side 20. The drop charging electrode 24 shown in FIG. 1 preferably has a bent configuration around the substrate 18.

The continuous ink jet print station includes a power source 26 for powering the resistive heater element to heat the substrate to a temperature sufficient to prevent condensation of fluid on the first side, as shown in FIG. 1. The power source 26 can comprise a pulse width modulated power source that varies the power to the discrete heater elements This power source can vary the on time relative to the off time within a defined period to modify the total power supply to a resistive element. Typically the defined period is 1000 microseconds with an on time of 300 microseconds.

Alternatively, the power source 26 can vary the voltage supplied to the discrete heater elements.

The embodiments have been described in detail with particular reference to certain preferred embodiments thereof, but it will be understood that variations and modifications can be effected within the scope of the embodiments, especially to those skilled in the art.

PARTS LIST

12. drop generator
14. jet array
15. ink droplets
16. drop charging assembly
17. catcher assembly
18. substrate
20. first side of substrate
21. second side of substrate
22*a*. first resistive heater element
22*b*. second resistive heater element
22*c*. third resistive heater element
22*d*. fourth resistive heater element
22*e*. fifth resistive heater element
22*f*. sixth resistive heater element
23. third side of substrate
24. charging electrode

25. drop charging electronics
26. power source
34. circuit layer
36. resistor layer
38. dielectric coating layer
40. fluid system to provide fluid to a drop generator
42. jet array a midpoint
43. conductors

What is claimed is:

1. A continuous ink jet print station comprising a fluid system to provide fluid to a drop generator, wherein the drop generator comprises a jet array, a midpoint, and a catcher assembly opposite the jet array for returning fluid to the fluid system, wherein the print station comprises:

a. a drop charging assembly disposed opposite the jet array for charging drops from fluid projected from the jet array comprising:

i. a substrate comprising a first side facing the jet array, wherein the first side comprises a first side surface area;

ii. multiple resistive heater elements placed on the substrate on a side different from the first side but aligned with the jet array and in proximate relation to the first side, wherein the multiple resistive heater elements are discontinuously disposed on portions of the substrate;

iii. at least one charging electrode disposed on the first side in communication with drop charging electronics; and b. a power source to provide voltage to the resistive heater elements to heat the substrate to a temperature sufficient to prevent condensation of fluid on the first side while minimizing distortion of the first side.

2. The print station of claim 1, wherein the resistive heater elements are disposed on the substrate in pairs symmetrically about the midpoint of the jet array.

3. The print station of claim 2, wherein at least six resistive heater elements are disposed on the substrate in pairs symmetrically about the midpoint of the jet array.

4. The print station of claim 1, wherein the resistive heater elements are disposed on the substrate symmetrically about the midpoint of the jet array.

5. The print station of claim 1, wherein the resistive heater element is formed by depositing at least three connected layers of thick film directly on the substrate without an adhesive.

6. The print station of claim 5, wherein the three connected layers comprise a circuit layer, resistor layer and a dielectric coating layer.

7. The print station of claim 6, wherein the connected layers are printed on the substrate.

8. The print station of claim 6, wherein the three connected layers are printed in sequence.

9. The print station of claim 1, wherein the resistive heater element is laminated to the substrate.

10. The print station of claim 1, wherein the resistive heater element is placed on the substrate by a method selected from the group consisting: vacuum deposit, sputtering, evaporation, vapor deposition, and combinations thereof.

11. The print station of claim 1, wherein the power source is a DC power supply.

12. The print station of claim 1, wherein the power source is a pulse width modulated power source.

13. The print station of claim 1, wherein the substrate is a ceramic, glass, metal, polymer, composites thereof, laminates thereof, or combinations thereof.

14. The print station of claim 1, wherein the multiple resistive heater elements are placed only on the side different from the first side.

15. The print station of claim 1, wherein the multiple resistive heater elements are not placed on the first side.

16. A continuous ink jet print station comprising a fluid system to provide fluid to a drop generator, wherein the drop generator comprises a jet array and a midpoint of the jet array, and wherein the print station comprises:

a. a drop charging assembly disposed opposite the jet array for charging drops from fluid projected from the jet array comprising:

i. a substrate comprising a first side facing the jet array, wherein the first side comprises a first side surface area;

ii. multiple resistive heater elements placed on the substrate on a side different from the first side but aligned with the jet array and in proximate relation to the first side, wherein the multiple resistive heater elements are discontinuously disposed on portions of the substrate;

iii. at least one charging electrode disposed on the first side in communication with drop charging electronics; and b. a power source to provide voltage to the resistive heater elements to heat the substrate to a temperature sufficient to prevent condensation of fluid on the first side while minimizing distortion of the first side, and, wherein the substrate comprises:

a. a second side comprising a common edge with the first side and a second side surface area greater than the first side surface area;

b. a third side comprising a common edge with the first side opposite the common edge of the second side and a third side surface area greater than the first side surface area, wherein at least one charging electrode is disposed on the first side and the resistive heater elements are disposed on the third side.

17. A continuous ink jet print station comprising a fluid system to provide fluid to a drop generator, wherein the drop generator comprises a jet array and a midpoint of the jet array, and wherein the print station comprises:

a. a drop charging assembly disposed opposite the jet array for charging drops from fluid projected from the jet array comprising:

i. a substrate comprising a first side facing the jet array, wherein the first side comprises a first side surface area;

ii. multiple resistive heater elements placed on the substrate on a side different from the first side but aligned with the jet array and in proximate relation to the first side, wherein the multiple resistive heater elements are discontinuously disposed on portions of the substrate;

iii. at least one charging electrode disposed on the first side in communication with drop charging electronics; and b. a power source to provide voltage to the resistive heater elements to heat the substrate to a temperature sufficient to prevent condensation of fluid on the first side while minimizing distortion of the first side, and, wherein each resistive element comprises a separate power source.

* * * * *